United States Patent [19]

Bonfiglioli et al.

[11] Patent Number: 4,905,651

[45] Date of Patent: Mar. 6, 1990

[54] DEVICE FOR FORMING AND METERING AN AIR AND FUEL MIXTURE FOR AN INTERNAL COMBUSTION ENGINE

[75] Inventors: Silverio Bonfiglioli, Via Belvedere; Gianni Fargnoli, Via Goldoni, Italy

[73] Assignee: Weber S.r.l., Turin, Italy

[21] Appl. No.: 185,071

[22] Filed: Apr. 22, 1988

[30] Foreign Application Priority Data

Apr. 30, 1987 [IT] Italy ..... 67371 A/87

[51] Int. Cl.[4] ..... F02M 61/14

[52] U.S. Cl. ..... 123/445; 123/470; 123/472; 123/547; 123/556; 123/585; 261/DIG. 82

[58] Field of Search ..... 123/445, 470, 472, 585, 123/556, 547, 543; 261/DIG. 82, DIG. 39, 44.6

[56] References Cited

U.S. PATENT DOCUMENTS

| | | | |
|---|---|---|---|
| 4,235,375 | 11/1980 | Melotti | 123/470 |
| 4,436,071 | 3/1984 | Hafner et al. | 123/472 |
| 4,539,962 | 9/1985 | Nichols | 123/470 |

FOREIGN PATENT DOCUMENTS

| | | | |
|---|---|---|---|
| 0137470 | 4/1985 | European Pat. Off. | 123/470 |
| 55-156239 | 12/1980 | Japan | 123/585 |
| 59-162361 | 9/1984 | Japan | 123/470 |
| 2025522 | 1/1980 | United Kingdom | 261/DIG. 39 |

*Primary Examiner*—Andrew M. Dolinar

*Attorney, Agent, or Firm*—Albert L. Jeffers; Richard L. Robinson

[57] ABSTRACT

A device comprising a body in which is formed a chamber in which fuel is mixed with air; a cylindrical mixture delivery duct the opening of which is controlled by a throttle valve; and a body cover to which is fitted a fuel injector for supplying atomized fuel into the mixing chamber; the aforementioned mixing chamber comprising at least a first and second portion defined by differently tapered surfaces, and a third portion defined by a cylindrical surface equal in diameter to the aforementioned cylindrical mixture delivery duct; the axial length of the cylinderical surface of the third portion of the mixing chamber, measured between the axis of the throttle valve and the top edge of the third portion itself, being at least equal to the radius of the circular contour of the aforementioned throttle valve.

8 Claims, 4 Drawing Sheets

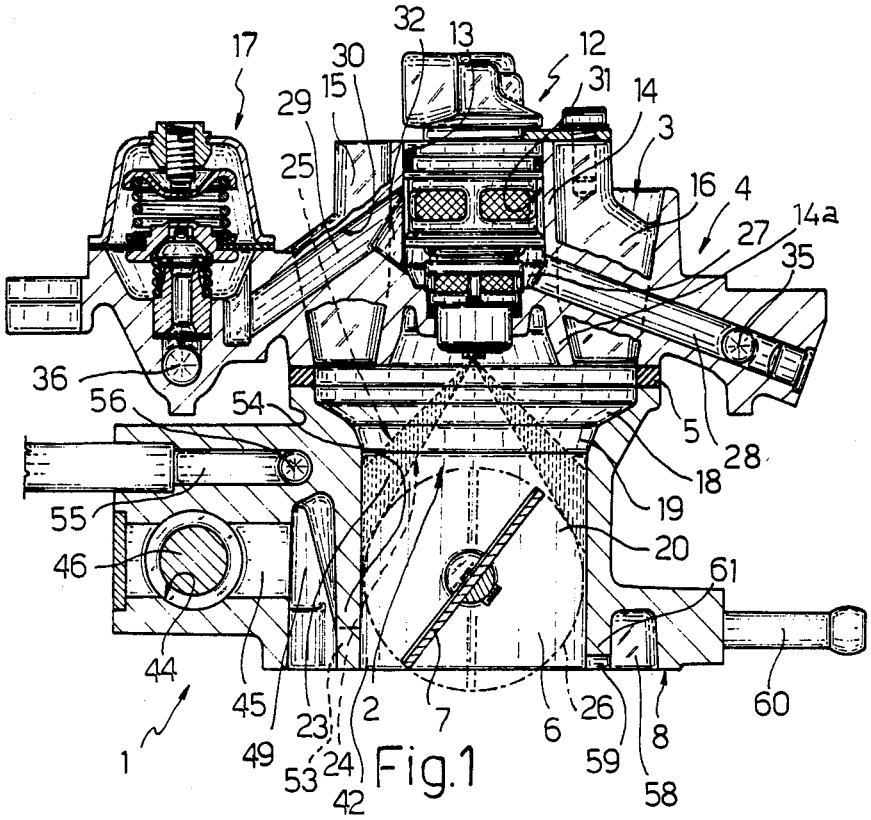
Fig.1
Fig.4
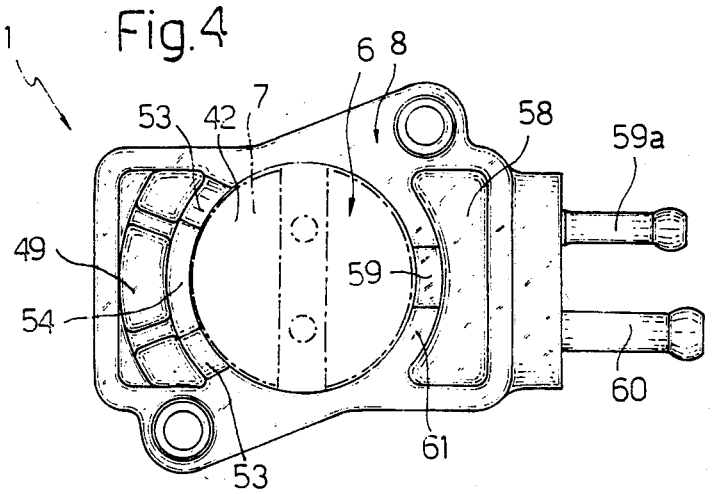

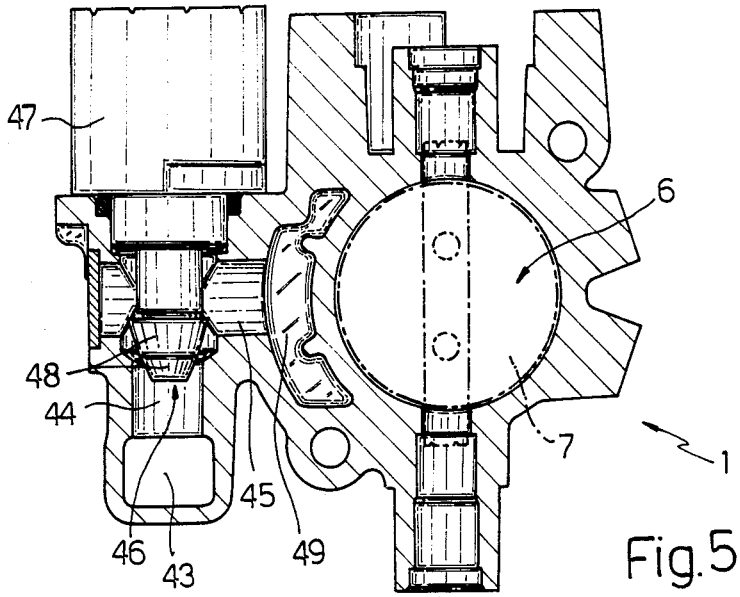
Fig.5
Fig.8
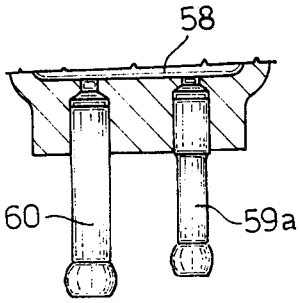

DEVICE FOR FORMING AND METERING AN AIR AND FUEL MIXTURE FOR AN INTERNAL COMBUSTION ENGINE

BACKGROUND OF THE INVENTION

The present invention relates to a device for forming and metering an air and fuel mixture to the manifold of an internal combustion engine, of the type comprising an electromagnetic fuel metering and atomizing valve for supplying predetermined fuel quantities in the form of atomized particles.

Devices of the aforementioned type are generally known to comprise a body, in which is formed a chamber in which atomized fuel is mixed with air, and a cylindrical mixture delivery duct, the opening of which is controlled by a circular throttle valve.

Such devices also comprise a body cover in which are formed a duct and a seat for fuel injector, for supplying air and fuel respectively into the said mixing chamber. The said cover is usually also fitted with a pressure regulator for maintaining constant pressure of the fuel supplied by the injector.

Devices of the aforementioned type present a number of drawbacks.

A major shortcoming of certain types of the aforementioned devices is that they fail to provide for a perfectly homogeneous air and fuel mixture under all operating conditions, due to the swirling motion inside the mixing chamber being insufficient for homogeneously blending the air and fuel particles. Furthermore, fuel drops are formed on the surface of the throttle valve and the cylindrical duct supplying the mixture to the manifold, thus impairing low-speed performance of the engine and dissipating part of the energy supplied by the injector at the fuel atomizing stage. This is due to the atomized fuel jet being blown by the air stream on to the surfaces of the duct and/or throttle, thus resulting in the formation of fuel drops which, moving irregularly along the cylindrical mixture delivery duct, invariably impair engine performance, particularly at low speed.

Certain types of the aforementioned devices fail to provide for steady supply of the mixture as the throttle is opened, particularly in the case of very samll angles. Also, on such devices, the fuel duct arrangement connecting the fuel intake fitting to the injector and the latter to the pressure regulator is fairly complex, thus resulting in variable load loses, particularly over the duct portion between the injector and pressure regulator, and involving fairly complex, unreliable construction designs. Finally, on devices of the aforementioned type, mixing additional air supplied to a given portion of the delivery duct downstream from the throttle, at idling speed or for cold starting of the engine, also involves a number of problems. The said additional air is known to be supplied by a bypass connecting an air intake hold in the device cover to the said delivery duct portion; the said delivery duct usually being provided with a plugging member controlled by an actuator. The location at which the said bypass comes out inside the mixture delivery duct invariably prevents homogeneous mixing of the said additional air with the mixture itself.

SUMMARY OF THE INVENTION

The aim of the present invention is to provide a device for forming and metering an air and fuel mixture for an internal combustion engine of the type briefly described above, but involving none of the aforementioned drawbacks. With this aim in view, according to the present invention, there is provided a device for forming and metering an air and fuel mixture for an internal combustion engine, said device comprising a body in which is formed a chamber in which fuel is mixed with air; a cylindrical mixture delivery duct, the opening of which is controlled by a circular throttle; and a cover fitted on the said body and in which are formed a duct for supplying air inside the said mixing chamber, and a seat for a fuel injector for supplying atomized fuel into the said mixing chamber, said cover also being provided with a pressure regulator for maintaining constant pressure of the fuel supplied by the said injector; characterised by the fact that the said mixing chamber comprises at least a first and second portion defined by differently tapered surfaces, and a third portion defined by a cylindrical surface equal in diameter to the said cylindrical mixture delivery duct; the axial length of the said cylindrical surface of the said third portion of the said mixing chamber, measured between the axis of the said throttle valve and the top edge of the said third portion, being at least equal to the radius of the said circular contour of the said throttle valve.

BRIEF DESCRIPTION OF THE DRAWINGS

The present invention will be described by way of a non-limiting example with reference to the accompanying drawings, in which:

FIG. 1 shows a cross section of the device according to the present invention;

FIG. 4 shows a bottom plan view of the device according to the present invention;

FIG. 5 shows a section of the device along line V—V in FIG. 1;

FIG. 8 shows a section of a detail on the device along line VIII—VIII in FIG. 1.

DETAILED DESCRIPTION OF THE INVENTION

Figure 2:
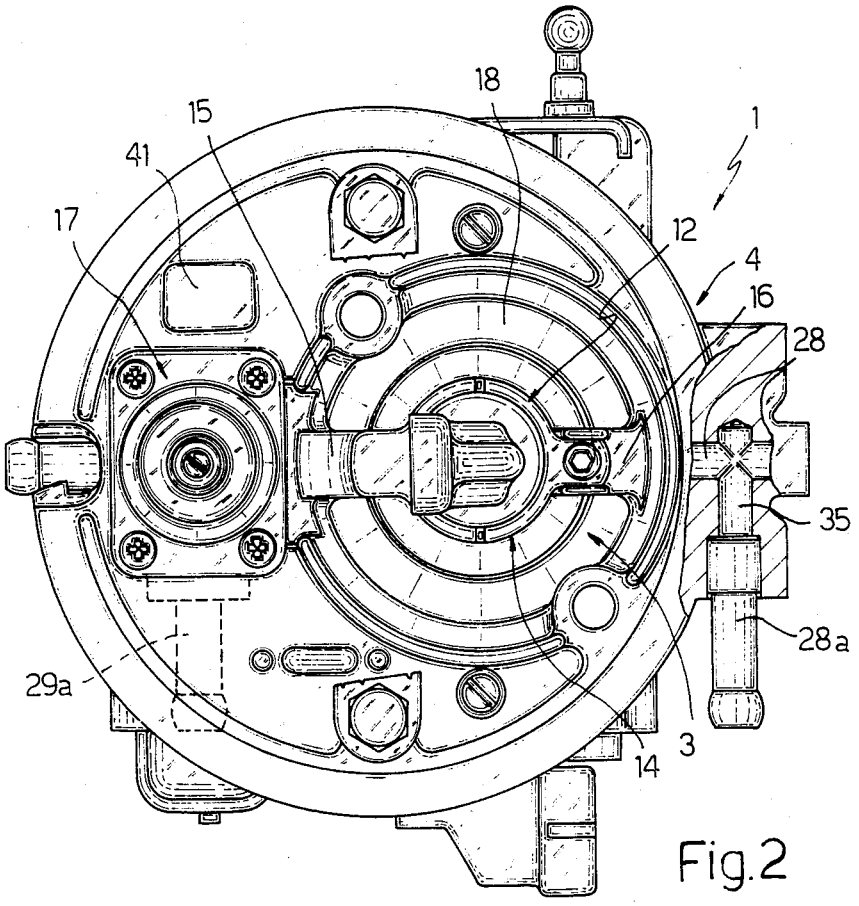
FIG. 2 shows a top plan view of the device according to the present invention.

The device for forming and metering an air and fuel mixture according to the present invention substantially comprises a body 1 in which is formed a chamber 2 in which fuel is mixed with air supplied by an air intake duct 3 formed inside a cover 4 placed on top of body 1 and secured to the same via the interposition of an insulating sealing member 5. Mixing chamber 2 comes out inside a mixture delivery duct 6 defined by a cylindrical surface and the opening of which is controlled by a throttle valve 7. The surface 8 defining the bottom of body 1 rests on the intake manifold of the internal combustion engine to which the device according to the present invention is screwed.

The said device also comprises a fuel injector 12 for supplying atomized fuel inside mixing chamber 2. The said injector 12 is housed inside seats 13 formed inside a tubular supporting element 14 substantially located inside air intake duct 3 and secured to cover 4 by a pair of connecting bridges 15 and 16 substantially located in the plane containing the longitudinal axis of intake duct 3. The said cover 4 is also fitted with a pressure regulator 17, conveniently of the type described in Patent Application n.67 859-A/85 filed on 11 Oct., 1985 by the present Applicant.

According to the present invention, mixing chamber 2 comprises a first portion 18 and a second portion 19 defined by a differently tapered surfaces, and a third portion 20 defined by a cylindrical surface equal in diameter to mixture delivery duct 6. As shown clearly in FIG. 1, the said second portion 19 is tapered less than the said first portion 18. The axial length of the said third portion 20, measured between the axis of throttle valve 7 and the top edge of the said third porton 20, is at least equal to the radius of the circular contour of throttle valve 7. Consequently, the spherical surface enveloped by the said contour during oscillation of throttle valve 7 is fully contained within the said third portion 20 of mixing chamber 2.

The said injector 12 produces a fuel jet 23 (shown by the hatching in FIG. 1) which is substantially contained between an inner and outer tapered surface having generating lines 24 and 25 in FIG. 1. The axial position of injector 12 in relation to body 1, and therefore also in relation to mixing chamber 2, is so selected that the said inner tapered surface is substantially tangent to the spherical surface enveloped by the circular contour of throttle valve 7 during oscillation of the same. As shown, in fact, in FIG. 1, generating lines 24 of the said inner tapered surface are substantially tangent to circular outline 26 of the said spherical surface.

The angles of the said inner and outer tapered surfaces of fuel jet 23 are conveniently 30° and 45°, which is therefore also the angle respective generating lines 24 and 25 of the said tapered surfaces form with the axis of mixing chamber 2.

Tubular supporting element 14 presents an axially-projecting annular collar 14*a*, and is formed inside with an annular fuel chamber 27 connected to a fuel intake fitting 28*a* (FIG. 2) via a straight duct portion 28. As shown clearly in FIG. 1, the said portion 28 forms an acute angle with the axis of tubular supporting element 14, and runs through bridge 16. A second straight duct portion 29 connects annular chamber 27 to pressure regulator 17, which portion 29 also forms an acute angle with the axis of tubular supporting element 14 and runs through the other of the said connecting bridges numbered 15 in FIG. 1. The said angle is made small enough for ensuring that generating lines 30 of the said straight duct portion intersect the inner surface of tubular supporting element 14 only once, thus enabling the said duct to be drilled by a tool inserted inside the said tubular supporting element. In fact, as shown clearly in FIG. 1, the said duct portion 29 may easily be drilled without interfering with other parts of supporting element 14 or cover 4.

Between annular chamber 27 and straight duct portion 29, there is conveniently formed a cavity 32 for reducing fuel pressure losses between the said chamber and the said duct portion. The said cavity 32 may also be formed by simply drillng supporting element 14.

To complete the fuel circuit, duct portion 28 is conveniently connected to a hole 35 connected to fitting 28*a* (FIG. 2), and pressure regulator 17 is connected via hole 36 (FIG. 1) to a further fitting 29*a* (FIG. 2) for collecting fuel drained off by the said pressure regulator.

Figure 7:
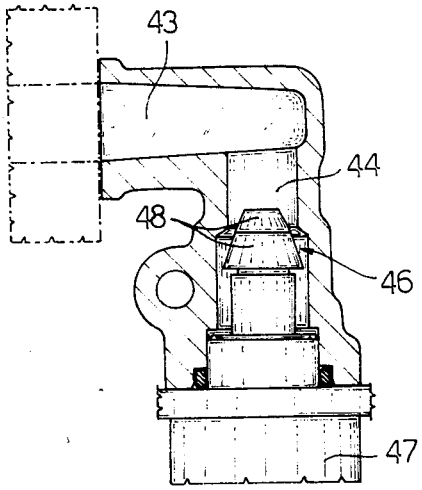
FIG. 7 shows a section of a detail on the device along line VII—VII in FIG. 1.
Figure 3:
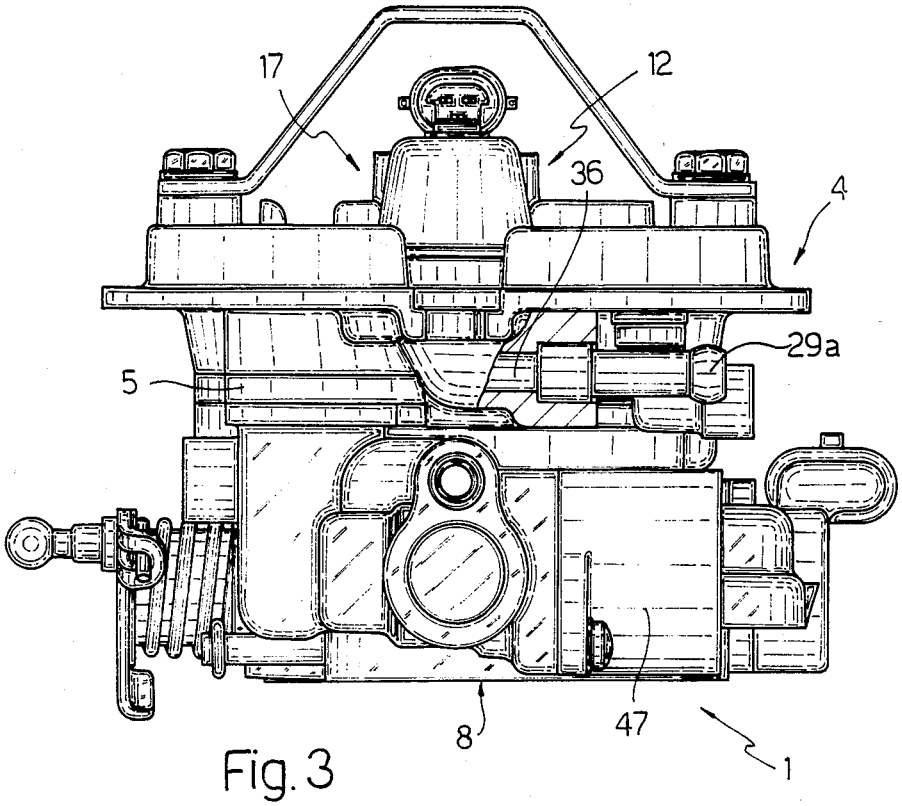
FIG. 3 shows a side view of the device according to the present invention.

The device according to the present invention also comprises an air bypass connecting an air intake hole 41 (FIG. 2) formed inside cover 4 with a portion 42 (FIGS. 1 and 4) of delivery duct 6 downstream from throttle valve 7, which bypass provides for supplying additional air for cold starting of the engine. The said bypass comprises holes 43, 44 and 45 formed inside body 1 (FIGS. 5 and 7). Between holes 44 and 45, there is provided a plugging member 46 controlled by an actuator 47, and conveniently presenting a pair of active tapered surfaces 48, for regulating air flow through the said bypass when so controlled by actuator 47 comprising an electric step motor connected to a control device.

Hole 45 comes out inside a distribution chamber 49 (FIGS. 1 and 5) formed inside body 1 and communicating with portion 42 of delivery duct 6 via a pair of slots 53 (FIG. 4) located symmetrically in relation to a plane through the axis of delivery duct 6 and perpendicular to the axis of rotation of throttle valve 7.

The width of each of the said slots conveniently increases along the axis of the said duct and away from the said throttle valve.

Distribution chamber 49 is separated from mixing chamber 2 and delivery duct 6 by a substantially cylindrical wall 54, and is open towards the bottom of body 1, as shown clearly in FIGS. 1 and 4.

Figure 6:
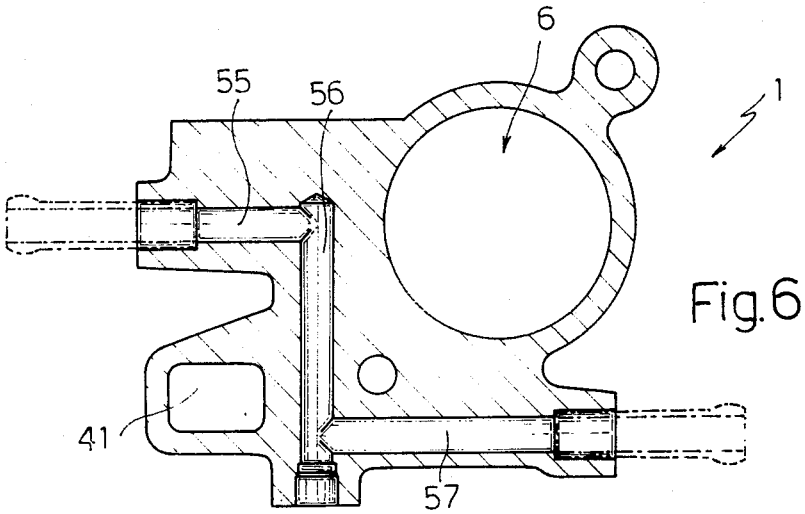
FIG. 6 shows a further section of the device along line VI—VI in FIG. 1.

Inside body 1, there is also formed a circuit for heating distribution chamber 49 and the parts of body 1 adjacent to the same, said circuit comprising at last three straight duct portions 55, 56 and 57 (FIG. 6) located in a plane perpendicular to the axis of delivery duct 6 and over distribution chamber 49, as shown clearly in FIG. 1. The device according to the present invention also comprises a cavity 58 (FIGS. 1, 4 and 8) communicating with the said portion 42 of delivery duct 6 downstream from throttle valve 7 via a slot 59. The said cavity communicates with at least a fitting 59*a* connected to a duct (not shown) for transmitting a pressure signal from the said portion 42 to a pressure detecting device (not shown). The said cavity also conveniently communicates with a second fitting 60 connected to a further fitting communicating with the oil pan on the engine.

In relation to delivery duct 6, the said cavity 58 is located diametrically opposite distribution chamber 49, and is separated from duct 6 by a substantially cylindrical wall 61.

As shown clearly in FIGS. 1 and 4, the said cavity 58 is open towards the bottom of body 1.

The device according to the present invention operates as follows.

The fuel circuit connecting fuel intake fitting 28*a* to injector 12 and pressure regulator 17 presents negligible load losses due to the short length of the ducts involved, particularly duct portions 28 and 29, and due to gradual fuel supply from annular chamber 27 to duct 29 via cavity 32. Thus, very little energy is required for fuel circulation, and regulator 17 immediately detects any change in pressure inside annular chamber 27.

Upon injector 12 being activated, the resulting fuel jet is substantially contained within the tapered surfaces defined by generating lines 24 and 25, so that the air stream from intake duct 3 is mixed substantially homogeneously with the fuel in the said jet. Furthermore, by virtue of the design of mixing chamber 2, i.e. tapered surfaces 18 and 19 and annular collar 14*a*, air swirls are produced for homogeneously mixing the atomized fuel and air.

Any atomized fuel in the said jet contacting the surface of mixing chamber 2 is deposited on the cylindrical surface of the said third portion 20 of the said chamber, as shown clearly in FIG. 1. As the said surface is substantially heated by the circuit consisting of duct portions 55, 56 and 57 (FIGS. 1 and 6), the said fuel evaporates almost immediately. Drops of fuel are thus prevented from forming on the surface of throttle valve 7, which is untouched by atomized fuel jet 23, or on the cylindrical surface of portion 20 of mixing chamber 2, due to the said surface being heated and any fuel deposited on the same evaporating almost immediately. This therefore provides for overcoming the drawbacks associated with prior devices, i.e. impaired performance, particularly at low engine speed, as a result of fuel drops forming on the surface of the throttle valve and mixing chamber.

At low engine speed, with throttle valve 7 set to a very small angle, the device according to the present invention provides for excellent, gradual response, by virtue of the fact that, under such conditions, throttle valve 7 uncovers the portion of delivery duct 6 subjected to fuel jet 23, i.e. the portion presenting the highest fuel concentration, as shown clearly in FIG. 1.

During cold starting of the engine, the additional air through intake hole 41 (FIG. 2) is fed into distribution chamber 49 (FIG. 1) through holes 43, 44 and 45, and through slots 53 to portion 42 beneath throttle valve 7. Air supply through the said duct is controlled by plugging member 46 as a function of displacement of the same according to two linear laws, each depending on tapered surface 48 controlling air flow through hole 44 (FIG. 5).

The air supplied through slots 53 to portion 42 mixes substantially homogeneously with the mixture from delivery duct 6 controlled by throttle valve 7, due to the location of the said slots in relation to the mixture flowing through the said duct. As the said slots are located some distance from and symmetrically in relation to a plane perpendicular to that containing the axis of throttle valve 7, air is supplied to areas wherein the mixture flows relatively slowly, and wherein the air can be mixed more homogeneously. Furthermore, the width of slots 53 is such as to maintain gradual air supply as the angle of throttle valve 7 is increased.

The location of distribution chamber 49 in the vicinity of holes 55, 56 and 57 of the said heating circuit prevents ice forming where slots 53 come out inside portion 42.

Finally, any fuel collecting on the cylindrical surface of delivery duct 6 in the vicinity of slot 59 is trapped inside cavity 58, thus preventing fuel from entering the duct connecting slot 59 to the pressure sensor.

Cavity 58 thus acts as a labyrinth in which fuel is collected and drained off under various device operating conditions, thus preventing fuel from reaching the pressure indicating device.

Notwithstanding the device according to the present invention provides for overcoming the drawbacks and considerably improving performance of prior devices of the same type, it is extremely compact, involves no complex component parts, and may thus be produced simply and cheaply using standard equipment.

To those skilled in the art it will be clear that changes may be made to the device as described and illustrated herein without, however, departing from the scope of the present invention.

We claim:

1. A device for forming and metering an air and fuel mixture for an internal combustion engine, said device comprising:

a body (1) in which is formed a chamber (2) in which fuel is mixed with air;

a cylindrical mixture delivery duct (6) having an opening controlled by a circular contour throttle valve (7) having a throttle axis, said circular contour of the said throttle valve generating a spherical surface during oscillation of the said throttle valve;

a cover (4) fitted on the said body and in which are formed a duct (3) for supplying air inside the said mixing chamber, and a seat (13) for a fuel injector (12) for supplying atomized fuel into the said mixing chamber, in which the said fuel injector (12) produces a fuel jet (23) substantially contained within a tapered inner and outer surface and in which the axial position of the said injector is selected so that the said inner tapered surface is substantially tangent to the said spherical surface, said cover also being provided with a pressure regulator (17) for maintaining constant pressure of the fuel supplied by the said injector;

the said mixing chamber (2) comprising at least a first (18) and second (19) portion defined by differently tapered surfaces, and a third portion (20) defined by a cylindrical surface equal in diameter to the said cylindrical mixture delivery duct (6) and having a top edge; and the axial length of the said cylindrical surface of the said third portion of the said mixing chamber, measured between the throttle axis of the said throttle valve and the top edge of the said third portion, being at least equal to the radius of the said circular contour of the said throttle valve.

2. A device as claimed in claim 1, in which the angles of the said inner and outer tapered surfaces of the said fuel jet are selected substantially as a function of the diameter of the said throttle valve.

3. A device for forming and metering an air and fuel mixture for an internal combustion engine, said device comprising:

a body (1) in which is formed a chamber (2) in which fuel is mixed with air;

a cylindrical mixture delivery duct (6) having an opening controlled by a circular contour throttle valve (7) having a throttle axis;

a cover (4) fitted on the said body and in which are formed a duct (3) for supplying air inside the said mixing chamber, and a seat (13) for a fuel injector (12) for supplying atomized fuel into the said mixing chamber, said cover also being provided with a pressure regulator (17) for maintaining constant pressure of the fuel supplied by the said injector;

the said cover being provided with a tubular supporting element (14) for the said injector and located inside the said air supply duct (3); the said tubular supporting element having an axis, an inner surface, and being connected to the said cover by a pair of connecting bridges (15, 16), and being formed inside with the said seat (13) for the said injector and an annular chamber (27) for fuel supplied to the said injector; and further including: at least a first straight fuel duct portion (28) connecting the said annular chamber (27) to a first fuel intake fitting (**28*a***) and forming a first acute angle with the axis of the said tubular supporting element

(14) and running through one of the said connecting bridges (16); a second straight fuel duct portion (29) connecting the said annular chamber (27) to the said pressure regulator (17) and forming a second acute angle with the axis of the said tubular supporting element and running through the other (15) of the said connecting bridges; the said second angle being sufficiently small for ensuring that the generating lines (30) of the surface of the said second straight duct portion intersect the inner surface of the said tubular supporting element (14) only once, thus enabling the said duct to be drilled by means of a tool inserted inside the said tubular supporting element;

the said mixing chamber (2) comprising at least a first (18) and second (19) portion defined by differently tapered surfaces, and a third portion (20) defined by a cylindrical surface equal in diameter to the said cylindrical mixture delivery duct (6) and having a top edge; and the axial length of the said cylindrical surface of the said third portion of the said mixing chamber, measured between the throttle axis of the said throttle valve and the top edge of the said third portion, being at least equal to the radius of the said circular contour of the said throttle valve.

4. A device as claimed in claim 3, in which, between the said annular chamber (27) of the said tubular supporting element (14) and the said second duct portion (29), there is formed a cavity (32) for reducing fuel pressure losses between the said chamber and the said second duct portion.

5. A device for forming and metering an air and fuel mixture for an internal combustion engine, said device comprising:

a body (1) in which is formed a chamber (2) in which fuel is mixed with air;

a cylindrical mixture delivery duct (6) having an opening controlled by a circular contour throttle valve (7) having a throttle axis;

a cover (4) fitted on the said body and in which are formed a duct (3) for supplying air inside the said mixing chamber, and a seat (13) for a fuel injector (12) for supplying atomized fuel into the said mixing chamber, said cover also being provided with a pressure regulator (17) for maintaining constant pressure of the fuel supplied by the said injector;

an air bypass (41) connecting an air intake hole formed in the said cover (4) with a portion (42) of the said mixture delivery duct downstream from the said throttle valve; the said bypass being provided with a plugging member (46) controlled by an actuator (47);

the said bypass coming out inside a distribution chamber (49) formed in the said body and communicating with the said portion (42) of the said mixture delivery duct via a pair of slots (53) arranged symmetrically in relation to a plane through the axis of the said delivery duct and perpendicular to the axis of the said throttle valve;

the said body including a circuit for heating the said distribution chamber (49) and parts of the said body adjacent to the same, and the said circuit comprising at least three straight duct portions (55, 56, 57) located in a plane perpendicular to the axis of the said mixture delivery duct and over the said distribution chamber (49);

the said mixture chamber (2) comprising at least a first (18) and second (19) portion defined by differently tapered surfaces, and a third portion (20) defined by a cylindrical surface equal in diameter to the said cylindrical mixture delivery duct (6) and having a top edge; and the axial length of the said cylindrical surface of the said third portion of the said mixing chamber, measured between the throttle axis of the said throttle valve and the top edge of the said third portion, being at least equal to the radius of the said circular contour of the said throttle valve.

6. A device as claimed in claim 5, in which the said distribution chamber (49) is separated from the said mixing chamber (2) and the said mixture delivery duct (6) by a substantially cylindrical wall (54) and is open towards the bottom of the said body.

7. A device for forming and metering an air and fuel mixture for an internal combustion engine, said device comprising:

a body (1) in which is formed a chamber (2) in which fuel is mixed with air;

a cylindrical mixture delivery duct (6) having an opening controlled by a circular contour throttle valve (7) having a throttle axis;

a cover (4) fitted on the said body and in which are formed a duct (3) for supplying air inside the said mixing chamber, and a seat (13) for a fuel injector (12) for supplying atomized fuel into the said mixing chamber, said cover also being provided with a pressure regulator (17) for maintaining constant pressure of the fuel supplied by the said injector;

the said mixing chamber (2) comprising at least a first (18) and second (19) portion defined by differently tapered surfaces, and a third portion (20) defined by a cylindrical surface equal in diameter to the said cylindrical mixture delivery duct (6) and having a top edge;

the axial length of the said cylindrical surface of the said third portion of the said mixing chamber, measured between the throttle axis of the said throttle valve and the top edge of the said third portion, being at least equal to the radius of the said circular contour of the said throttle valve;

a cavity (58) in said body (1) communicating with a portion (42) of the said mixture delivery duct (6) downstream from the said throttle valve via a slot (59); the said cavity communicating with at least a duct for transmitting a pressure signal from the said portion to a pressure indicating device;

the said cavity being located, in relation to the axis of the said mixture delivery duct (6), diametrically opposite a distribution chamber (49) and being separated from the said duct by a substantially cylindrical wall (61).

8. A device as claimed in claim 7, in which the said cavity (58) is open towards the bottom of the said body.

* * * * *